US009049763B1

(12) United States Patent
Chiang et al.

(10) Patent No.: US 9,049,763 B1
(45) Date of Patent: Jun. 2, 2015

(54) LED LUMINAIRE DRIVING CIRCUIT WITH HIGH POWER FACTOR

(71) Applicant: Chung-Shan Institute of Science and Technology, Armaments Bureau, Ministry of National Defense, Longtan Township, Taoyuan County (TW)

(72) Inventors: Hsuang-Chang Chiang, Taipei (TW); Chao-Tsung Ma, Miaoli (TW); Kun-Feng Chen, New Taipei (TW); Ying-Sun Huang, Taipei (TW)

(73) Assignee: CHUNG-SHAN INSTITUTE OF SCIENCE AND TECHNOLOGY, Taoyuan County (TW)

( * ) Notice: Subject to any disclaimer, the term of this patent is extended or adjusted under 35 U.S.C. 154(b) by 0 days.

(21) Appl. No.: 14/198,752

(22) Filed: Mar. 6, 2014

(51) Int. Cl.
*G05F 1/00* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/02; H05B 37/02
USPC ..... 315/291, 307, 308, 200 R, 209 R
See application file for complete search history.

(56) References Cited

U.S. PATENT DOCUMENTS

| | | | | |
|---|---|---|---|---|
| 6,009,000 | A * | 12/1999 | Siri | 363/21.09 |
| 6,504,315 | B2 * | 1/2003 | Kim | 315/224 |
| 2011/0199793 | A1 * | 8/2011 | Kuang et al. | 363/21.13 |
| 2012/0019714 | A1 * | 1/2012 | Hiramatu et al. | 348/370 |

* cited by examiner

*Primary Examiner* — Minh D A
(74) *Attorney, Agent, or Firm* — Anova Law Group, PLLC

(57) ABSTRACT

The present invention relates to an LED luminaire driving circuit with high power factor, comprising: a filter unit, a rectifier unit, a transformer unit, a power switch unit, a zero current detecting unit, a feedback unit, an error amplifier unit, and a power switch driving unit. Particularly, the LED luminaire driving circuit proposed by the present invention does not include any optocoupler feedback circuits, so it is able to effectively reduce the entire circuit manufacturing cost of this LED luminaire driving circuit. Moreover, this LED luminaire driving circuit can selectively work under CCM operation or DCM operation with high power factor (PF~1), and provide stable output voltage signal and output current signal to load end. In addition, this LED luminaire driving circuit performs excellent stability and current modulation error rate (<±3%).

13 Claims, 16 Drawing Sheets

LED LUMINAIRE DRIVING CIRCUIT WITH HIGH POWER FACTOR

BACKGROUND OF THE INVENTION

1. Field of the Invention

The present invention relates to the technology fields of LED luminaire driving circuits, and more particularly to an LED luminaire driving circuit with high power factor.

2. Description of the Prior Art

Recently, light-emitting diodes (LEDs) are widely applied to be the lighting device in human life. And currently, more and more families replace the traditional fluorescent lamps by LED lamps due to the issue of Energy Conservation and Carbon Reduction is more and more popular. However, since the power formation of the market electricity is AC power and the LED lamps are driven to emit light by DC power, it is necessary to dispose a power converting device between the market electricity and the LED lamps for converting the AC power to DC power.

With reference to FIG. 1, there is shown a circuit framework diagram of a BCM flyback converter with variable frequency control. The BCM (Boundary Conduction Mode) flyback converter with variable frequency control 1*a* shown by FIG. 1 is a peak-current-mode PWM (pulse width modulation) converter, and the engineers skilled in LED lamp driving circuit field are able to find the following drawbacks of the BCM flyback converter with variable frequency control 1*a* from the circuit framework of FIG. 1: (1) the voltage-sensing circuit 11*a* disposed at the input end of the BCM flyback converter with variable frequency control 1*a* would produce extra power consumption; and (2) the cut-off time of the secondary side current $I_{D_a}$ of the BCM flyback converter with variable frequency control 1*a* is fully decided by the output diode $D_{O_a}$, such that the cut-off time of the secondary side current $I_{D_a}$ cannot be precisely predicted and controlled.

Please refer to FIG. 2, there is shown the circuit framework diagram of another BCM flyback converter with variable frequency control. The BCM (Boundary Conduction Mode) flyback converter with variable frequency control 1*b* shown by FIG. 2 is a constant on-time control converter, and the engineers skilled in LED lamp driving circuit field can find the following drawbacks of the BCM flyback converter with variable frequency control 1*b* from the circuit framework of FIG. 2: the cut-off time of the secondary side current $I_{D_b}$ of the BCM flyback converter with variable frequency control 1*b* is fully decided by the output diode $D_{O_b}$, so the cut-off time of the secondary side current $I_{D_b}$ cannot be precisely predicted and controlled.

Referring to FIG. 3, which illustrates the circuit framework diagram of a DCM flyback converter with constant frequency control. The DCM (Discontinuous Conduction Mode) flyback converter with constant frequency control 1*c* shown by FIG. 3 is a voltage control converter, and the engineers skilled in LED lamp driving circuit field is able to easily know that the DCM flyback converter with constant frequency control 1*c* can merely be used for driving low power LED lamps because the DCM flyback converter with constant frequency control 1*c* includes higher switching current $I_{Q_C}$ under the same working power.

With reference to FIG. 4, there is shown the circuit framework diagram of a COT flyback converter with variable frequency control. The COT (Constant Off-Time) flyback converter with variable frequency control 1*d* shown by FIG. 4 is a peak-current-mode PWM (pulse width modulation) converter, and the engineers skilled in LED lamp driving circuit field are able to find that the COT flyback converter with variable frequency control 1*d* can be operated under discontinuous conduction mode, boundary conduction mode or continuous conduction mode (CCM); however, the COT flyback converter with variable frequency control 1*d* still includes the following drawbacks: the voltage-sensing circuit 11*d* disposed at the input end of the COT flyback converter with variable frequency control 1*d* would produce extra power consumption.

Please refer to FIG. 5, which illustrates the circuit framework diagram of a constant-frequency control flyback converter. The constant-frequency control flyback converter 1*e* shown by FIG. 5 is a current-clamp control converter, and the engineers skilled in LED lamp driving circuit field can easily understand that the constant-frequency control flyback converter 1*e* carries out the power factor correction by using the constant current (CC) error amplifier 11*e*, the constant voltage (CV) error amplifier 12*e*, the opticalcoupler feedback circuit 13*e*, the triangle compensation signal $V_{tri}$, and the power device driving circuit 14*e* to produce a PWM driving signal to the power transistor $Q_{PW}'$. In spite of that, the constant-frequency control flyback converter 1*e* still includes the following drawbacks: the entire manufacturing cost of the constant-frequency control flyback converter 1*e* is too expensive because the disposing of the opticalcoupler feedback circuit 13*e*.

Accordingly, in view of the conventional LED lamps driving circuits all include drawbacks and shortcomings, the inventor of the present application has made great efforts to make inventive research thereon and eventually provided an LED luminaire driving circuit with high power factor.

SUMMARY OF THE INVENTION

The primary objective of the present invention is to provide an LED luminaire driving circuit with high power factor, which especially integrated with a zero current detecting unit, a feedback unit and an error amplifier unit without using any input-end voltage detecting signal. The LED luminaire driving circuit can be used for driving high power LED lamps, and work without producing any extra power consumption.

The another objective of the present invention is to provide an LED luminaire driving circuit with high power factor, which integrated with a zero current detecting unit, a feedback unit and an error amplifier unit. Particularly, the LED luminaire driving circuit proposed by the present invention does not include any optocoupler feedback circuits, so it is able to effectively reduce the entire circuit manufacturing cost of this LED luminaire driving circuit. Moreover, this LED luminaire driving circuit can selectively work under CCM operation or DCM operation with high power factor (PF~1), and provide stable output voltage signal and output current signal to load end. In addition, this LED luminaire driving circuit performs excellent stability and current modulation error rate (<+3%).

Accordingly, to achieve the primary objective of the present invention, the inventor of the present invention provides an LED luminaire driving circuit with high power factor, comprising:

a filter unit, coupled to an input source for receiving an AC signal;

a rectifier unit, coupled to the filter unit for receiving the AC signal via the filter unit, and then treats the AC signal with a rectifying process so as to output an input signal;

a transformer unit, coupled to the rectifier unit for receiving the input signal, and then transforms the input signal having a peak input voltage to an output signal having a peak output voltage, so as to output the output signal to an LED lighting unit for making the LED lighting unit emit light;

a power switch unit, coupled between the rectifier unit and the transformer unit and used for treating the input signal with switching control;

a zero current detecting unit, being coupled to the transformer unit and used for treating the output signal with a zero current detection, so as to output a zero current detection signal;

a feedback unit, being coupled to the zero current detecting unit and the power switch unit, wherein the feedback unit receives a power switch current and the zero current detection signal, and outputting a feedback signal according to the power switch current and the zero current detection signal;

an error amplifier unit, being coupled to the zero current detecting unit and the feedback unit for receiving the feedback signal, and then outputs an error amplification signal according to the feedback signal; and a power switch driving unit, being coupled to the power switch unit and the error amplifier unit for receiving the error amplification signal, and then outputs a driving signal to the power switch unit according to the error amplification signal, so as to drive the power switch unit to treat the input signal with switching control.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe an LED luminaire driving circuit with high power factor according to the present invention, embodiments of the present invention will be described in detail with reference to the attached drawings hereinafter.

Figure 1:
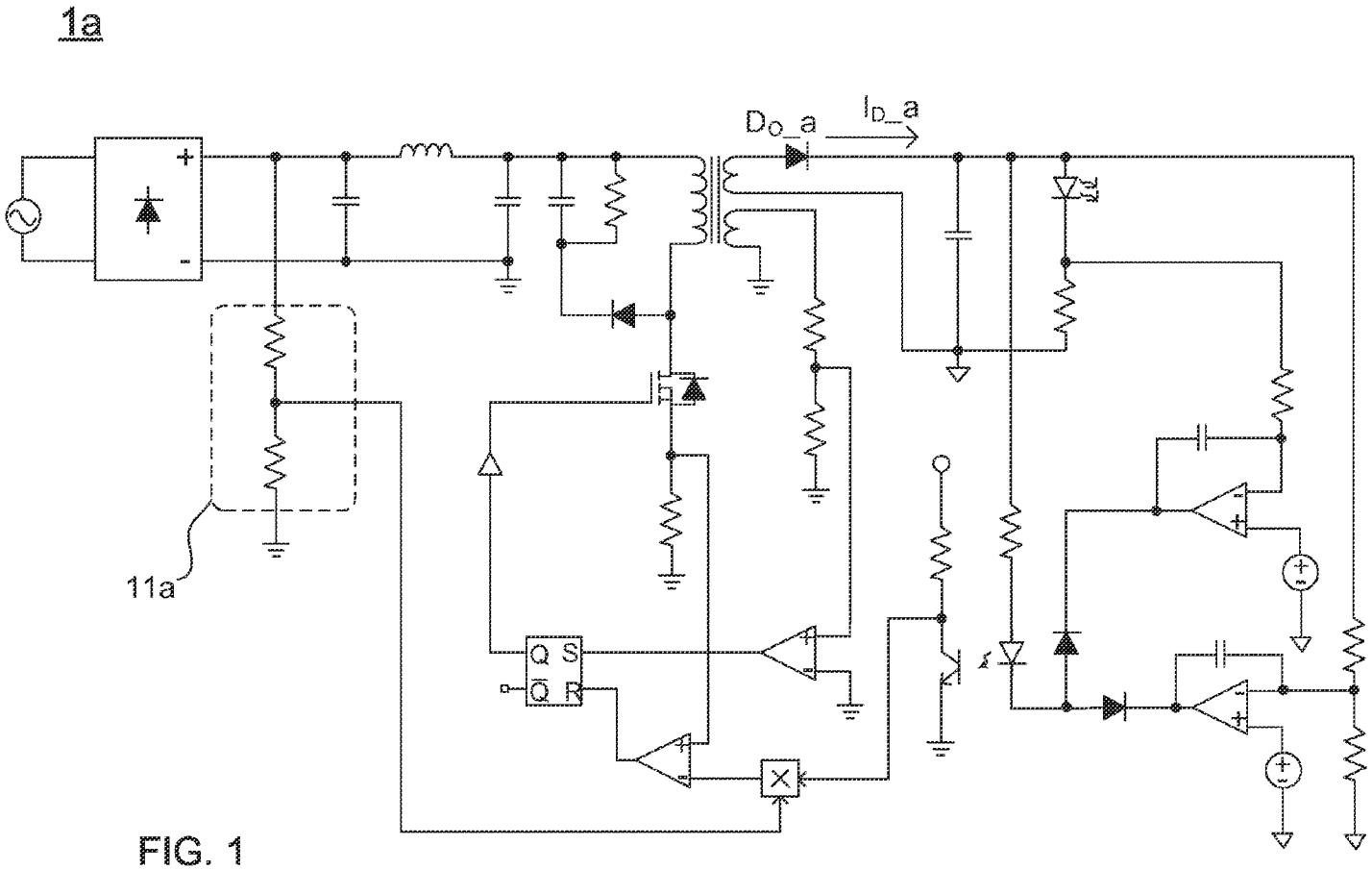
FIG. 1 (Prior Art)
FIG. 1 is a circuit framework diagram of a BCM flyback converter with variable frequency control.
Figure 2:
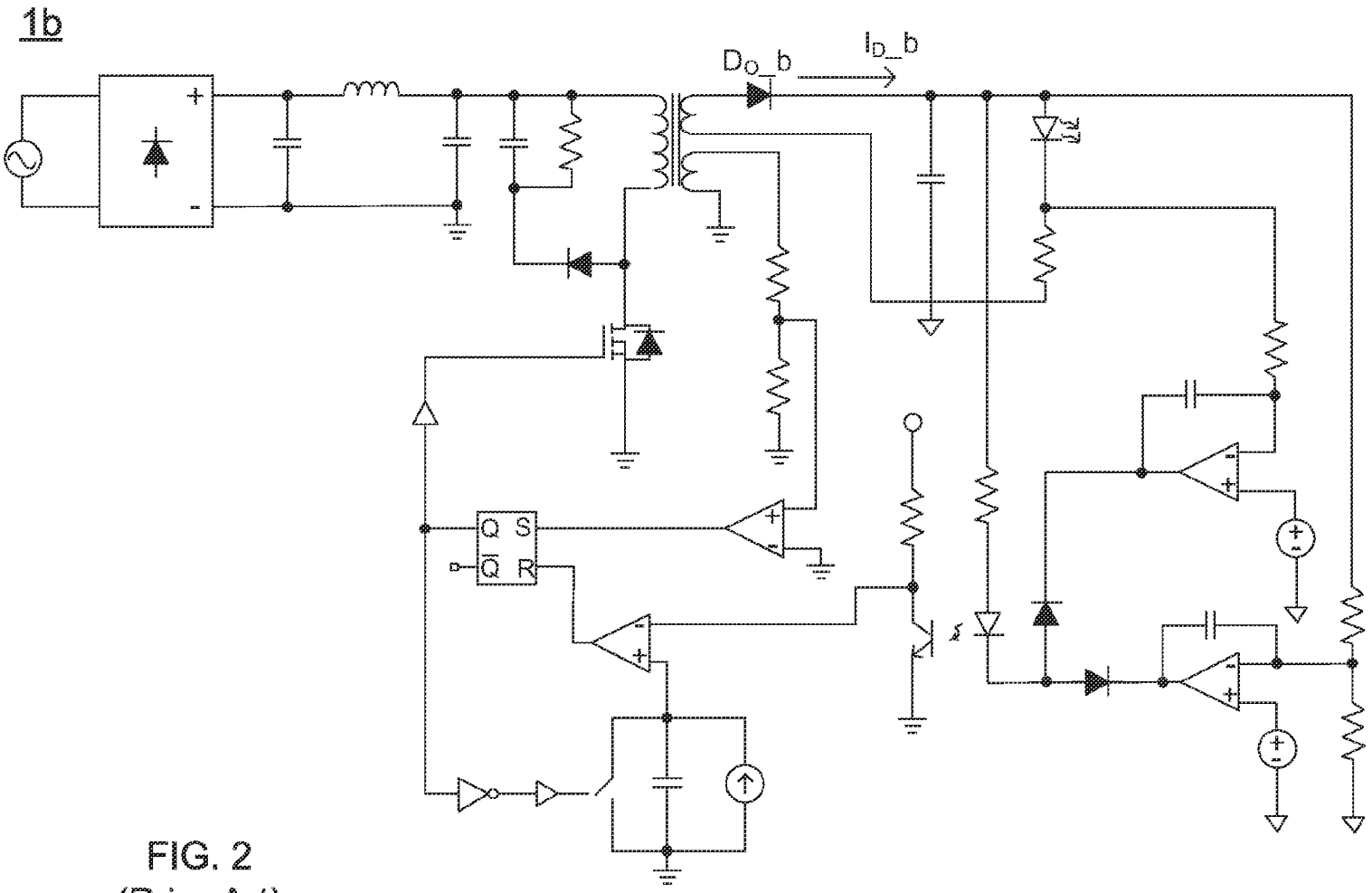
FIG. 2 (Prior Art)
FIG. 2 is a circuit framework diagram of another BCM flyback converter with variable frequency control.
Figure 3:
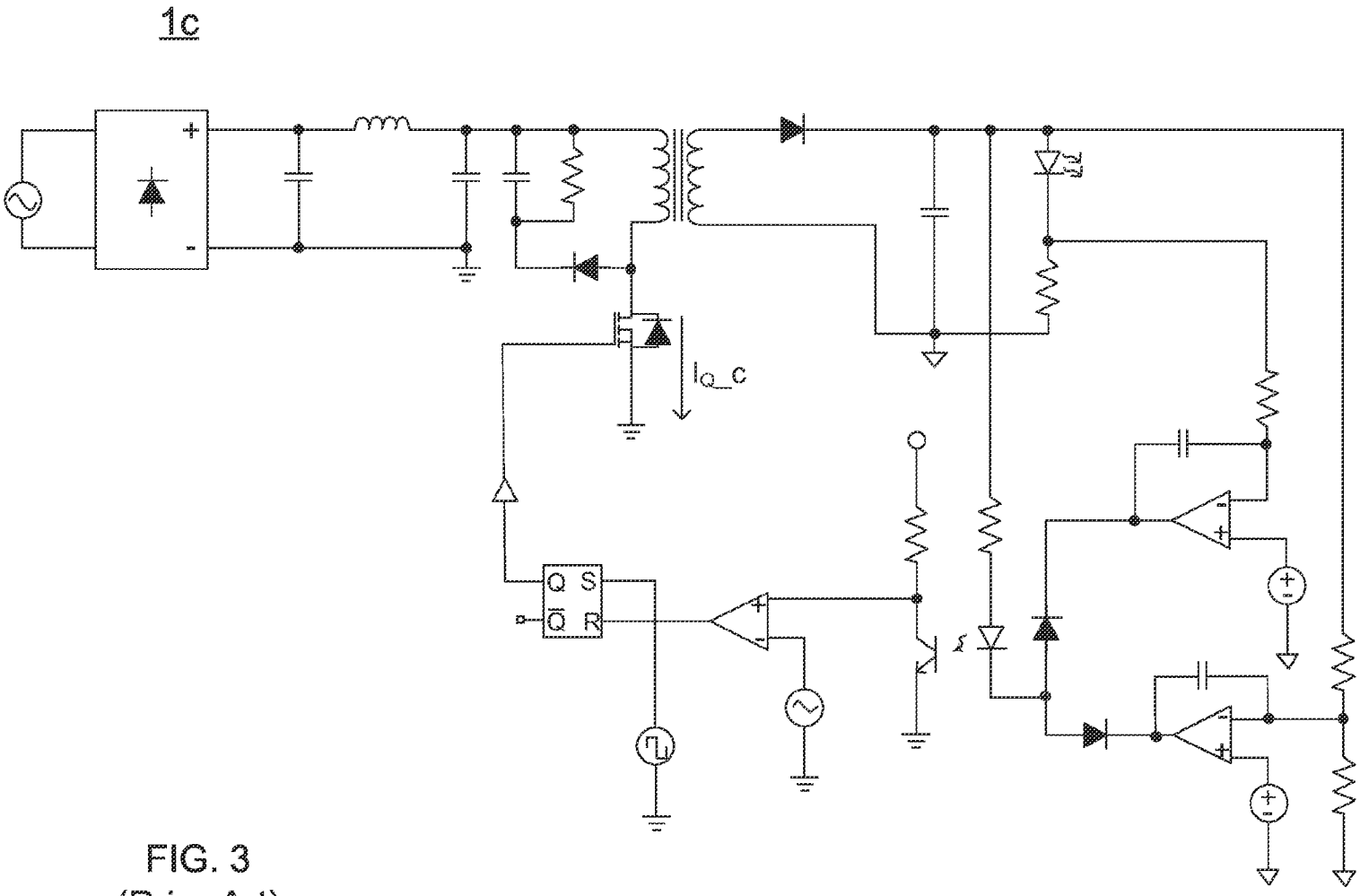
FIG. 3 (Prior Art)
FIG. 3 is a circuit framework diagram of a DCM flyback converter with constant frequency control.
Figure 4:
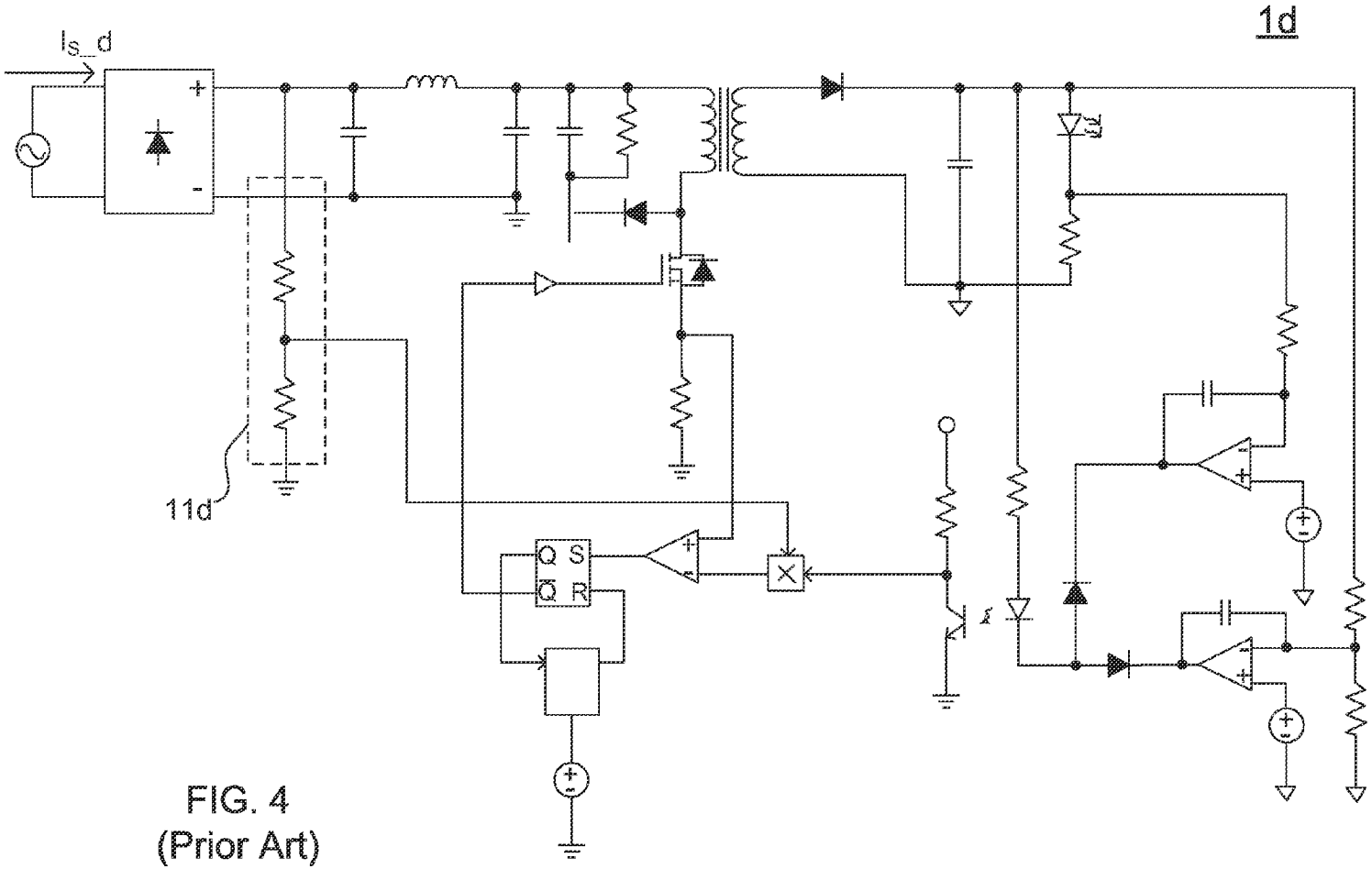
FIG. 4 (Prior Art)
FIG. 4 is a circuit framework diagram of a COT flyback converter with variable frequency control.
Figure 5:
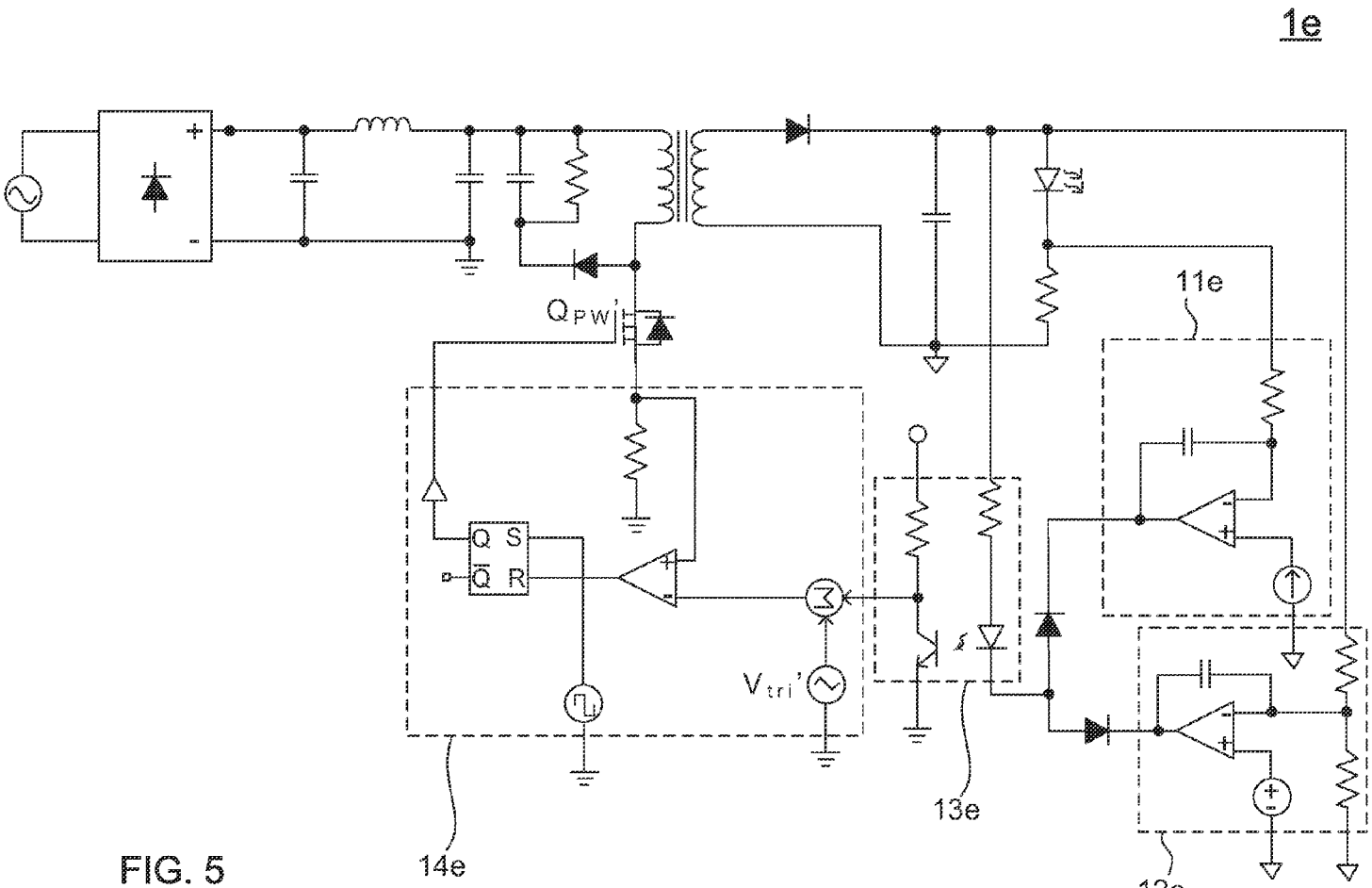
FIG. 5 (Prior Art)
FIG. 5 is a circuit framework diagram of a constant-frequency control flyback converter.
Figure 6:
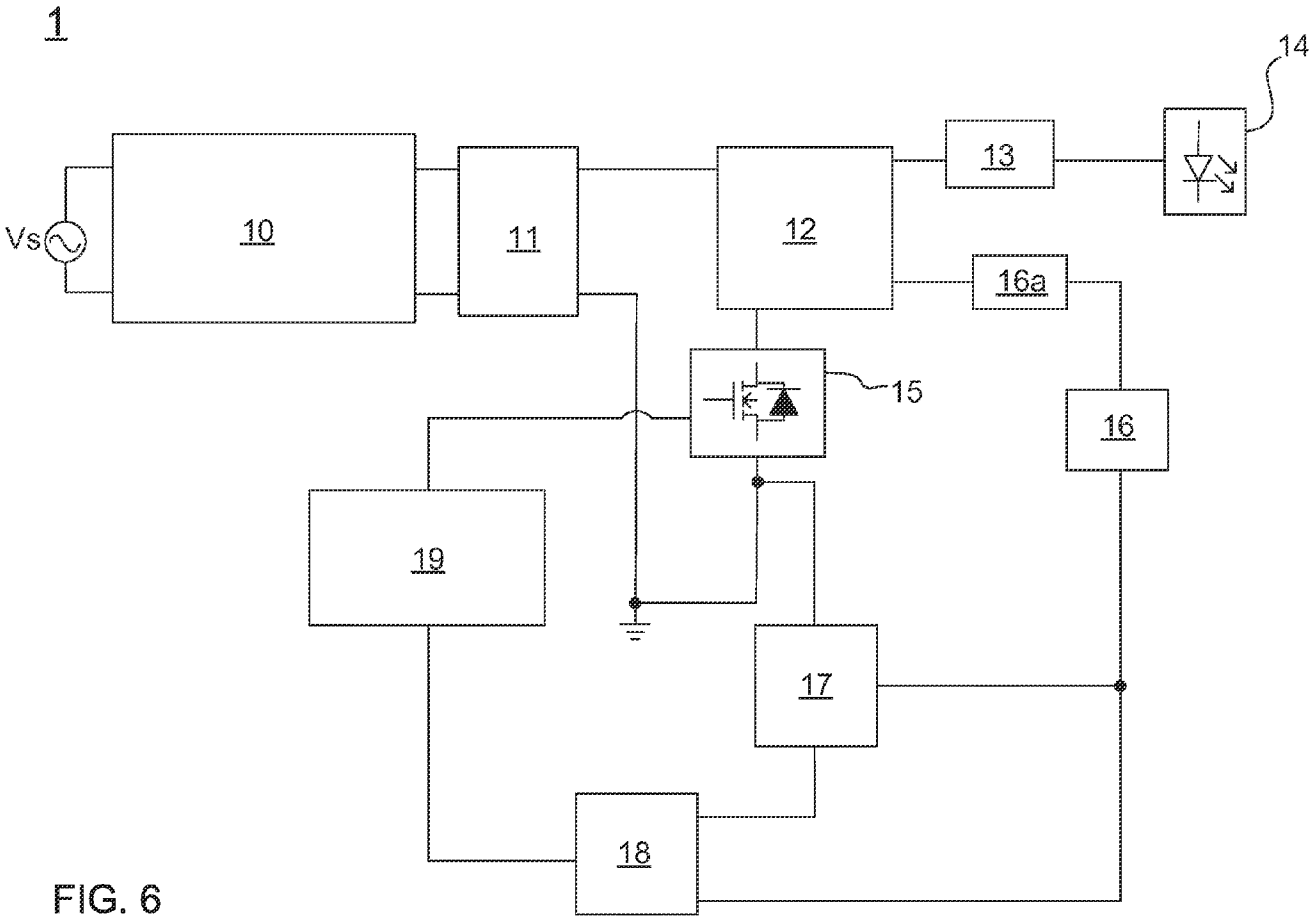
FIG. 6 is a circuit block diagram of an LED luminaire driving circuit with high power factor according to the present invention.

With reference to FIG. 6, there is shown a circuit block diagram of an LED luminaire driving circuit with high power factor according to the present invention. As shown in FIG. 6, the LED luminaire driving circuit 1 of the present invention includes: a filter unit 10, a rectifier unit 11, a transformer unit 12, an output unit 13, a power switch unit 15, a zero current detecting unit 16, a feedback unit 17, an error amplifier unit 18, and a power switch driving unit 19.

Figure 7:
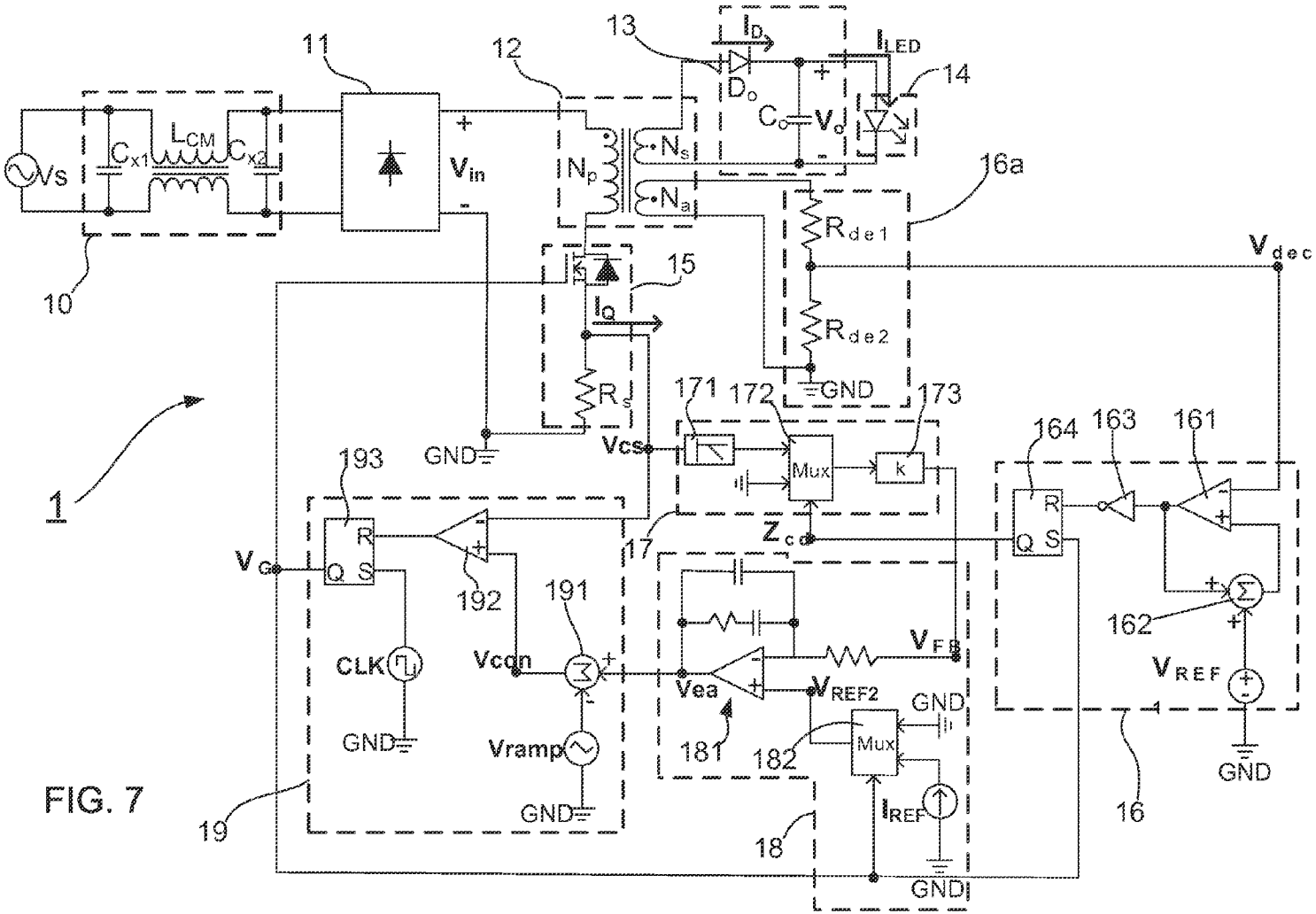
FIG. 7 is a circuit framework diagram of the LED luminaire driving circuit with high power factor according to the present invention.

Referring to FIG. 6 again, and please simultaneously refer to FIG. 7, which shows a circuit framework diagram of the LED luminaire driving circuit with high power factor. As shown in FIG. 6 and FIG. 7, the filter unit 10 is coupled to an input source $V_S$ for receiving an AC signal. The filter unit 10 consists of a first capacitor $C_{X1}$, a common mode chock winding $L_{CM}$ and a second capacitor $C_{X2}$, wherein the first capacitor $C_{X1}$ is connected across the two input terminals of the common mode chock winding $L_{CM}$, and the second capacitor $C_{X2}$ is connected across the two output terminals of the common mode chock winding $L_{CM}$. The rectifier unit 11 is a bridge rectifier, which is coupled to the filter unit 10 for receiving the AC signal via the filter unit 10, and then treats the AC signal with a rectifying process so as to output an input signal $V_{in}$.

The transformer unit 12 is coupled to the rectifier unit 11 and has a primary winding coil $N_p$, a secondary winding coil $N_S$ and an auxiliary winding coil $N_a$. In the present invention, the transformer unit 12 is used for receiving the input signal $V_{in}$, and then transforming the input signal $V_{in}$ having a peak input voltage to an output signal $V_O$ having a peak output voltage, so as to output the output signal $V_O$ to an LED lighting unit 14 for making the LED lighting unit 14 emit light.

Inheriting to above description, the output unit 13 is coupled between the transformer unit 12 and the LED lighting unit 14 for outputting the output signal $V_O$ to the LED lighting unit 14. As shown in FIG. 7, the output unit 13 is consisted of an output diode $D_O$ and an output capacitor $C_O$, wherein the output diode $D_O$ is coupled to the one terminal of the primary winding coil $N_p$ by one end thereof, and the output capacitor $C_O$ is coupled to the other end of the output diode $D_O$ by one end thereof, moreover the other end of the output capacitor $C_O$ is coupled to other terminal of the primary winding coil $N_p$ and the LED lighting unit 14.

The power switch unit 15 is a Power Metal-Oxide-Semiconductor Field-Effect Transistor (power MOSFET), and the source terminal of the power MOSFET Q is coupled with a source resistor $R_S$. The power switch unit 15 is coupled between the rectifier unit 11 and the transformer unit 12 and used for treating the input signal $V_{in}$ with switching control. Particularly, the LED luminaire driving circuit 1 of the present invention includes a zero current detecting unit 16, which is able to detect the output signal $V_O$ via a signal detecting unit 16*a* coupled between the transformer unit 12 and the zero current detecting unit 16. As shown in FIG. 6 and FIG. 7, the signal detecting unit 16*a* has at least one resistor ($R_{dect1}$, $R_{dect2}$), wherein one end of the resistor ($R_{dect1}$, $R_{dect2}$) is coupled to one terminal of the auxiliary winding coil $N_a$, and the other end of the resistor is coupled to the other terminal of the auxiliary winding coil $N_a$ and the ground of the LED luminaire driving circuit 1. Thus, the zero current detecting unit 16 is able to output a zero current detection signal $Z_{CD}$ after receiving a detection signal $V_{ded}$ from the signal detecting unit 16*a*.

The zero current detecting unit 16 consists of a comparator 161, an adder 162, an inverter 163, and a Set/Reset flip flop 164, wherein the comparator 161 is coupled to the signal detecting unit 16a for receiving the detection signal $V_{dec}$. The an adder 162 is coupled between a first input end and an output end of the comparator 161, moreover the adder 162 is further coupled with a reference signal $V_{REF1}$. Besides, the inverter 163 is coupled to the output end of the comparator 161, and the Set/Reset flip flop 164 is respectively coupled to the invertor 163 and the power switch unit 15 by one reset end and one set end thereof.

Inheriting to above description, the feedback unit 17 is coupled to the zero current detecting unit 16 and the power switch unit 15. In the present invention, the feedback unit 17 is used for receiving a power switch current $I_Q$ of the power switch unit 15 and the zero current detection signal $Z_{CD}$, and then outputting a feedback signal $V_{FB}$ according to the power switch current $I_Q$ and the zero current detection signal $Z_{CD}$. As shown in FIG. 6 and FIG. 7, the feedback unit 17 includes a low pass filter 171 and a multiplexer 172, wherein the low pass filter 171 is coupled to power switch unit 15 for receiving the power switch current $I_Q$, so as to treat the power switch current $I_Q$ with a low pass filtering process. The multiplexer 172 is coupled to the low pass filter 171 and the zero current detecting unit 16 for receiving the zero current detection signal $Z_{CD}$ and the low-pass-filtered power switch current $I_Q$, so as to output the feedback signal $V_{FB}$. Moreover, the feedback unit 17 further includes a relay coupled between the multiplexer 172 and the error amplifier unit 18.

The error amplifier unit 18 is coupled to the zero current detecting unit 16 and the feedback unit 17 for receiving the feedback signal $V_{FB}$, and then outputs an error amplification signal Vea according to the feedback signal $V_{FB}$. In addition, the power switch driving unit 19 is coupled to the power switch unit 15 and the error amplifier unit 18 for receiving the error amplification signal $V_{ea}$, so as to output a driving signal $V_G$ to the power switch unit 15 according to the error amplification signal Vea; therefore, the power switch unit 15 is able to treat the input signal Vin with switching control according to the driving signal $V_G$.

As shown in FIG. 6 and FIG. 7, the error amplifier unit 18 consists of a proportional-integral (PI) compensator 181 and a multiplexer 182, wherein the PI compensator 181 is coupled to the feedback unit 17 for receiving the feedback signal $V_{FB}$, and the multiplexer 182 is coupled to the power switch driving unit 19 for receiving the driving signal $V_G$. Moreover, the multiplexer 182 is further coupled with a reference current signal $I_{REF}$, such that the multiplexer 182 is able to output a reference voltage signal $V_{REF}$ to the PI compensator 181 according to the driving signal $V_G$ and the reference current signal $I_{REF}$, and then the PI compensator 181 may output the error amplification signal $V_{ea}$ to a subtractor 191 of the power switch driving unit 19 according to the reference voltage signal $V_{REF}$ and the feedback signal $V_{FB}$.

Besides the error amplification signal $V_{ea}$, the subtractor 191 coupled to the error amplifier unit 18 simultaneously receiving the a ripple signal $V_{rip}$, therefore the subtractor 191 outputs a conversion signal $V_{con}$ to a comparator 192 of the power switch driving unit 19 according to the ripple signal $V_{rip}$ and the error amplification signal $V_{ea}$. The comparator 192, coupled to the subtractor 191 and the power switch unit 15, is used for respectively receiving the conversion signal $V_{con}$ and a power switch voltage signal $V_{CS}$ of the power switch unit 15; therefore, the comparator 192 would output a comparison signal according to the power switch voltage signal $V_{CS}$ and the conversion signal $V_{con}$. As shown in FIG. 6 and FIG. 7, the power switch driving unit 19 further includes a Set/Reset flip flop 193, which is coupled to the output end of the comparator 193 by one reset end thereof; moreover, one set end of the Set/Reset flip flop 193 is coupled with a clock signal CLK, such that the Set/Reset flip flop 193 is able to output the driving signal $V_G$ to the power switch unit 15 according the clock signal CLK and the comparison signal received from the comparator 193.

Figure 8:
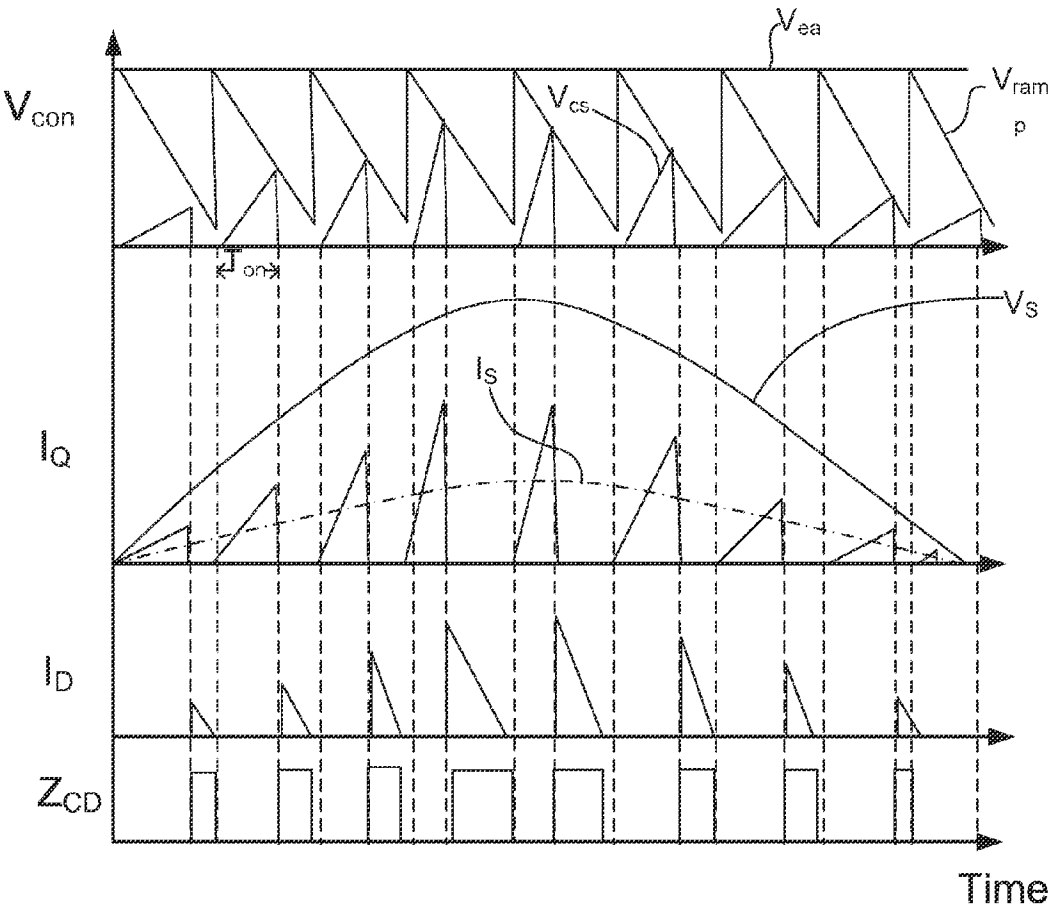
FIG. 8 shows signal waveforms of the LED luminaire driving circuit working under DCM operation.

Therefore, above descriptions have been introduce the detailed circuit framework of the LED luminaire driving circuit 1 proposed by the present invention; Next, in order to prove the practicability and performance of the LED luminaire driving circuit 1, a variety of circuit simulation are completed and the related simulation data are recorded. Please refer to FIG. 8, which shows signal waveforms of the LED luminaire driving circuit working under DCM (Discontinuous Conduction Mode) operation. From the signal waveforms, it is able to derive the following formula (1): $V_{con}=V_{ea}-m_aT_{on}=m_1T_{on}$. In above-mentioned formula (1), $V_{con}$ is the conversion signal outputted by the subtractor 191 of the power switch driving unit 19, $V_{ea}$ is the error amplification signal $V_{ea}$ outputted by the PI compensator 181 of the error amplifier unit 18, and $T_{on}$ is the conduction time of the power switch unit 15, $m_a$ is the slope of the ripple signal $V_{rip}$, and $m_1$ is the slope of the ripple signal $V_{CS}$ of the power MOSFET Q of the power switch unit 15. Moreover, the $I_D$ marked in FIG. 8 means the diode current of the output diode $D_O$ of the output unit 13.

Figure 9:
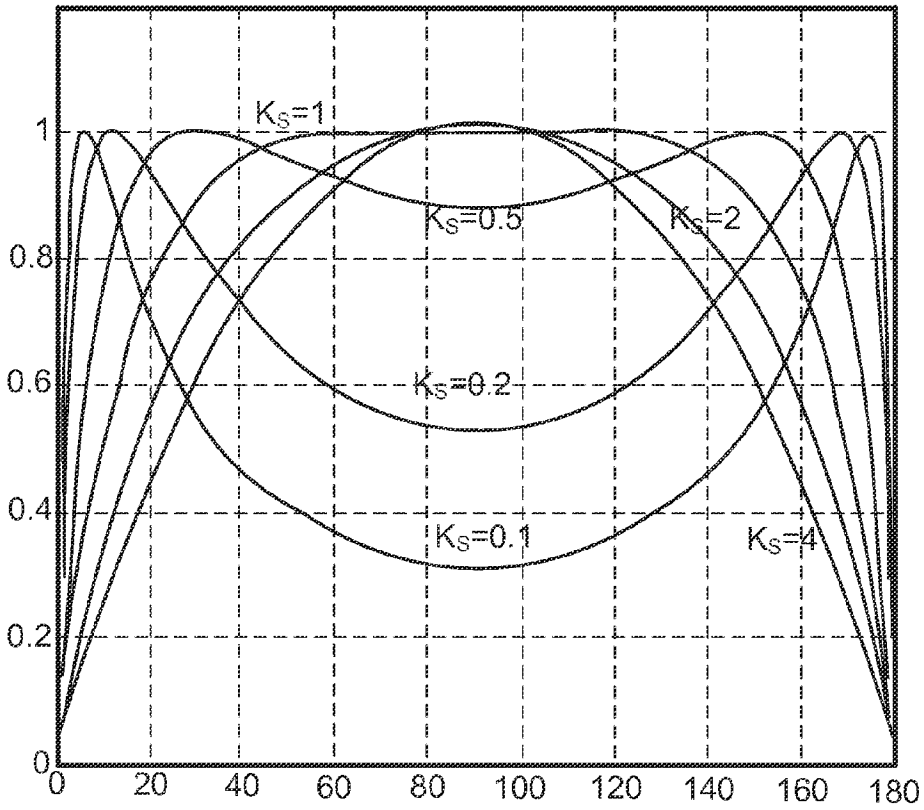
FIG. 9 is a plot of an input current as a function of the conduction angle.

Since $m_1=(R_S*V_S)/L_P$ and $I_{pk}=(T_{on}*m_1)/R_S$, the $T_{on}$ can be calculated by the formula of $T_{on}=V_{ea}/(m_1+m_a)$. Herein $L_p$ means the self-inductance of the transformer unit 12 and $I_{pk}$ means the peak value of the power switch current $I_Q$. Moreover, because input current $I_S$ is equal to the average value of the power switch current $I_Q$ in a switching period, the input current $I_S$ can be calculated by using the formula of $I_S=(I_{pk}*T_{on})/2T_S$; wherein $T_S$ is the switching period of the power MOSFET Q of the power switch unit 15. Subsequently, it is able to derive the following formula (2): $I_S=(V_{ea}^2/2R_ST_S)*[m_1/(m_1+m_a)^2]$. Eventually, after letting $m_a=K_SM_{1,max}=K_SR_S(V_{sm}/L_p)$ and substituting different slope compensating parameter $K_S$ and slope $m_a$ into above-mentioned formula (2), a plot of the input current $I_S$ as a function of the conduction angle can be obtained and shown as FIG. 9. From the plot of FIG. 9, it is able to observe that the greater value the slope compensating parameter $K_S$ is set, the less distortion the input current $I_S$ shows.

Figure 10:
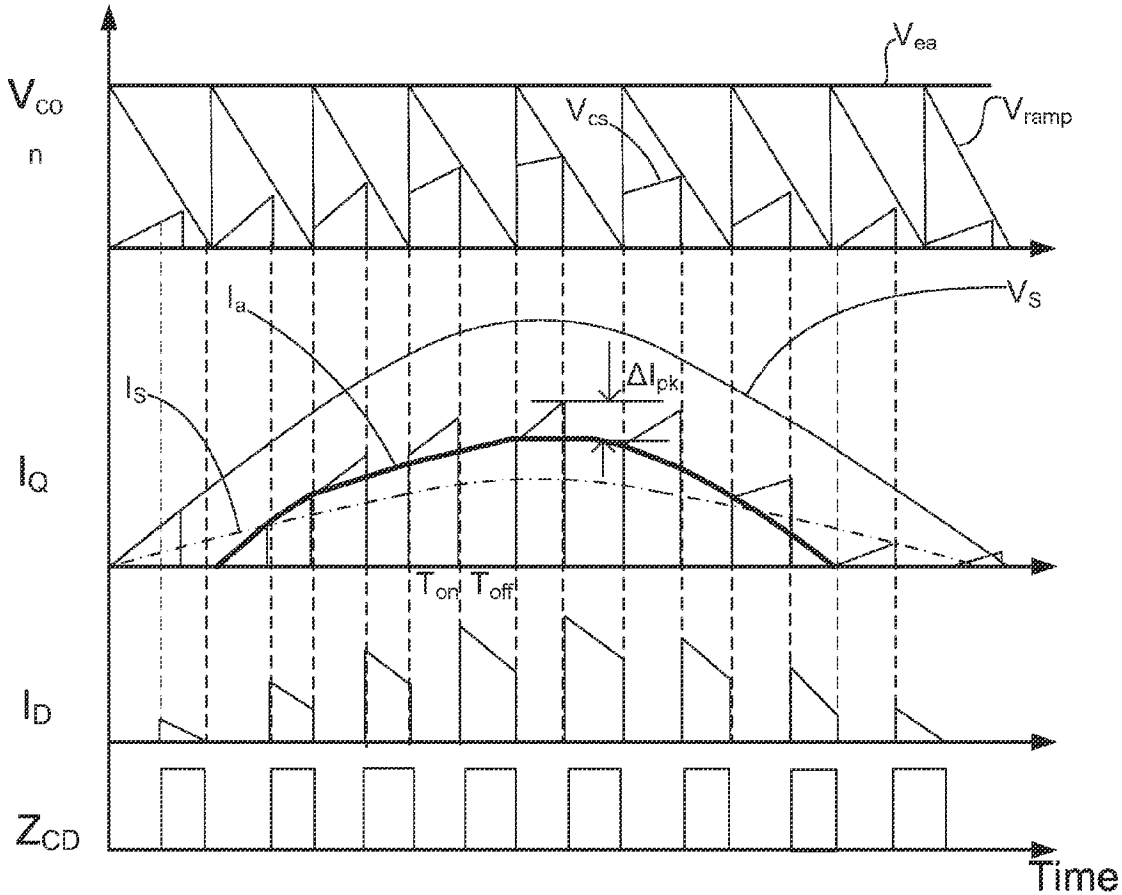
FIG. 10 shows signal waveforms of the LED luminaire driving circuit working under CCM operation.
Figure 11:
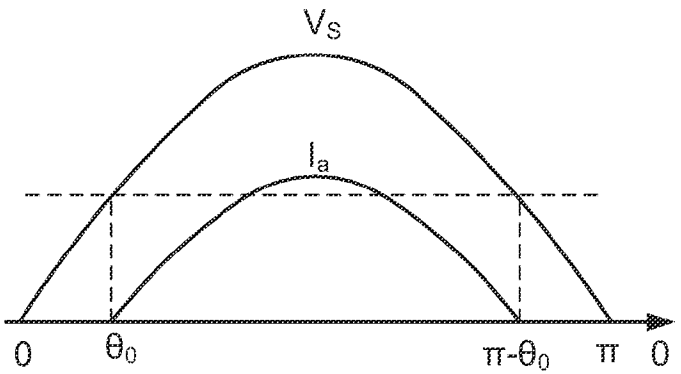
FIG. 11 shows curves of the input current and the conduction angle.
Figure 12:
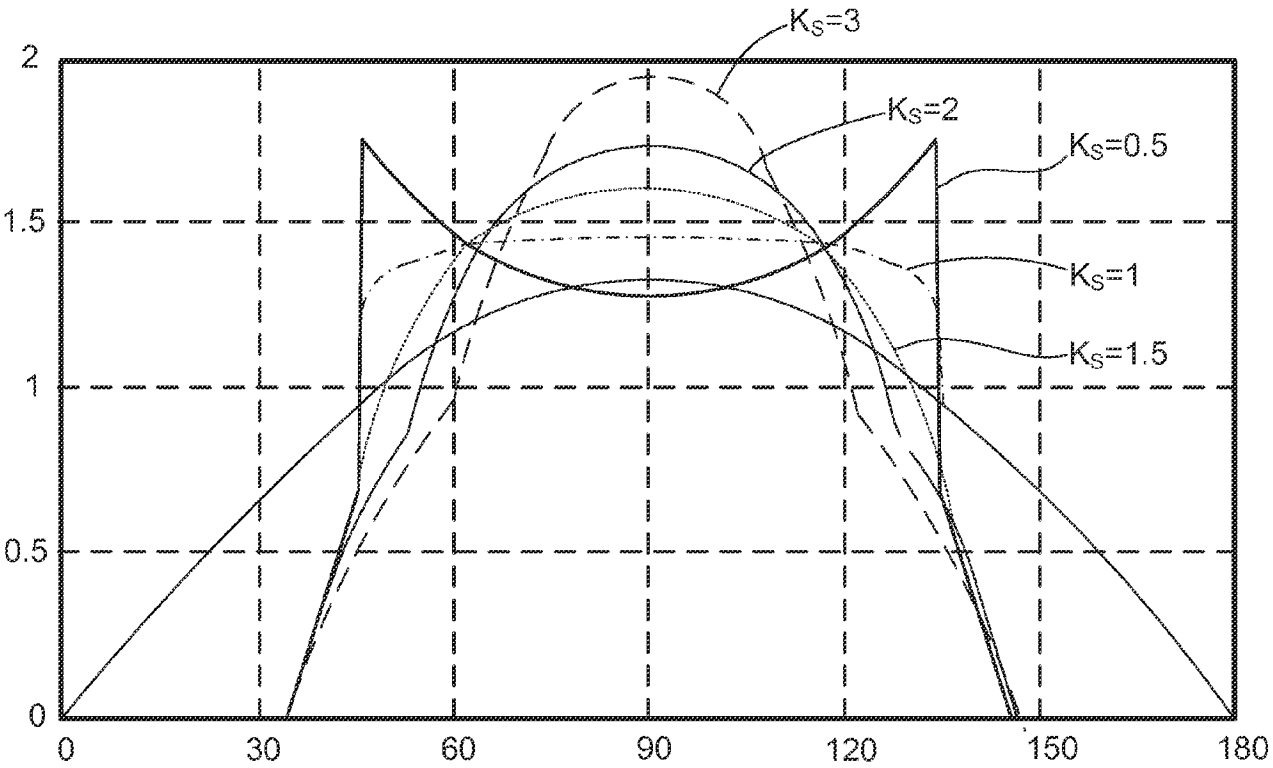
FIG. 12 is a plot of the input current as a function of the conduction angle.

Continuously referring to FIG. 10, which shows signal waveforms of the LED luminaire driving circuit working under CCM (continuous conduction mode) operation. From FIG. 10, it is able to derive the following formula (3): $\Delta I_{pk}=(m_1*T_{on})/R_S$. Because input current $I_S$ is equal to the average value of the power switch current $I_Q$ in a switching period, the input current $I_S$ can be calculated by using the following formula (4): $I_S=I_a(T_{on}/T_S)+(\Delta I_{pk}T_{on})/2T_S$, wherein the LED luminaire circuit 1 of the present invention would work under DCM operation when $I_a<I_{pk}$. Moreover, as FIG. 11 shows, when the conduction angle is ranged between $\theta_0$ and $\pi-\theta_0$ and different slope compensating parameter $K_S$ is substituted into above-mentioned formula (4), a plot of the input current $I_S$ as a function of the conduction angle can be obtained and shown as FIG. 12. From the plot of FIG. 12, it is able to observe that the greater value the slope compensating parameter $K_S$ is set, the less distortion the input current $I_S$ shows.

Figure 13A:
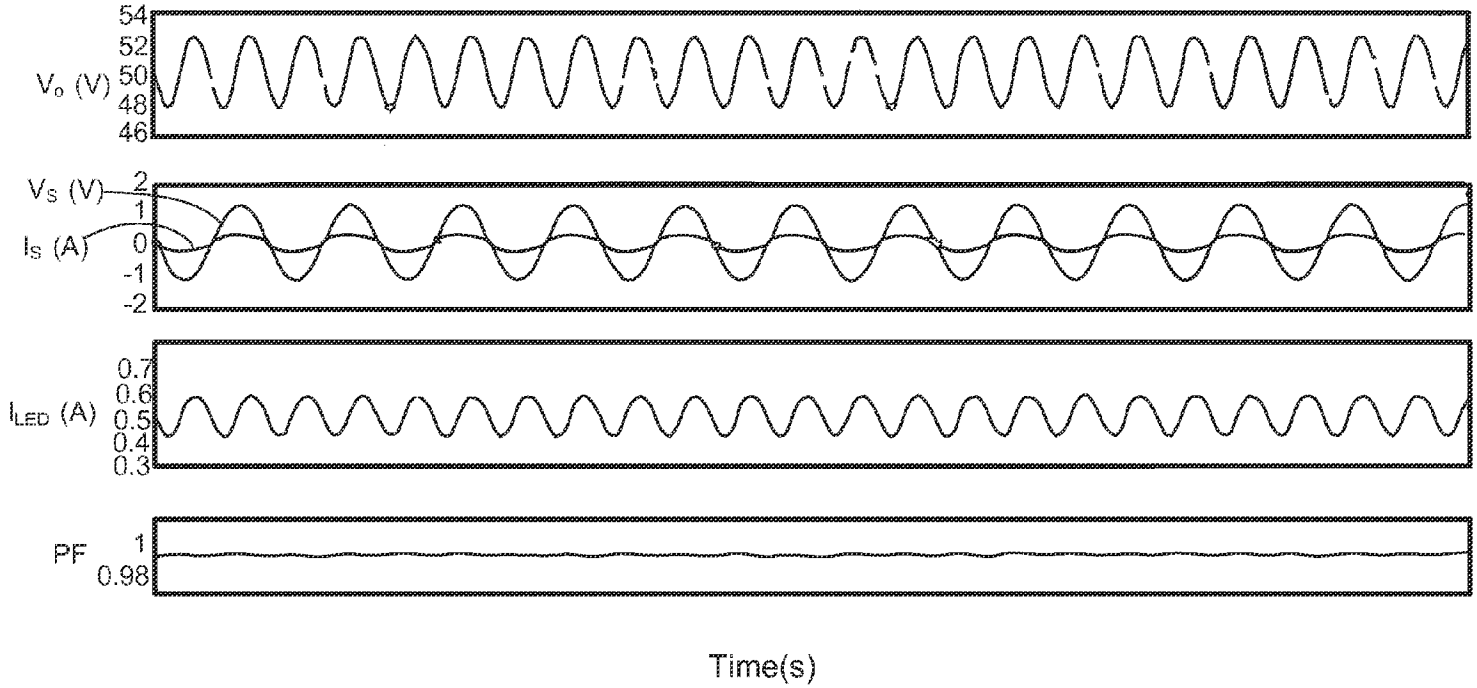
FIG. 13A and FIG. 13B show simulated signal waveforms of the LED luminaire driving circuit working under CCM operation.
Figure 13B:
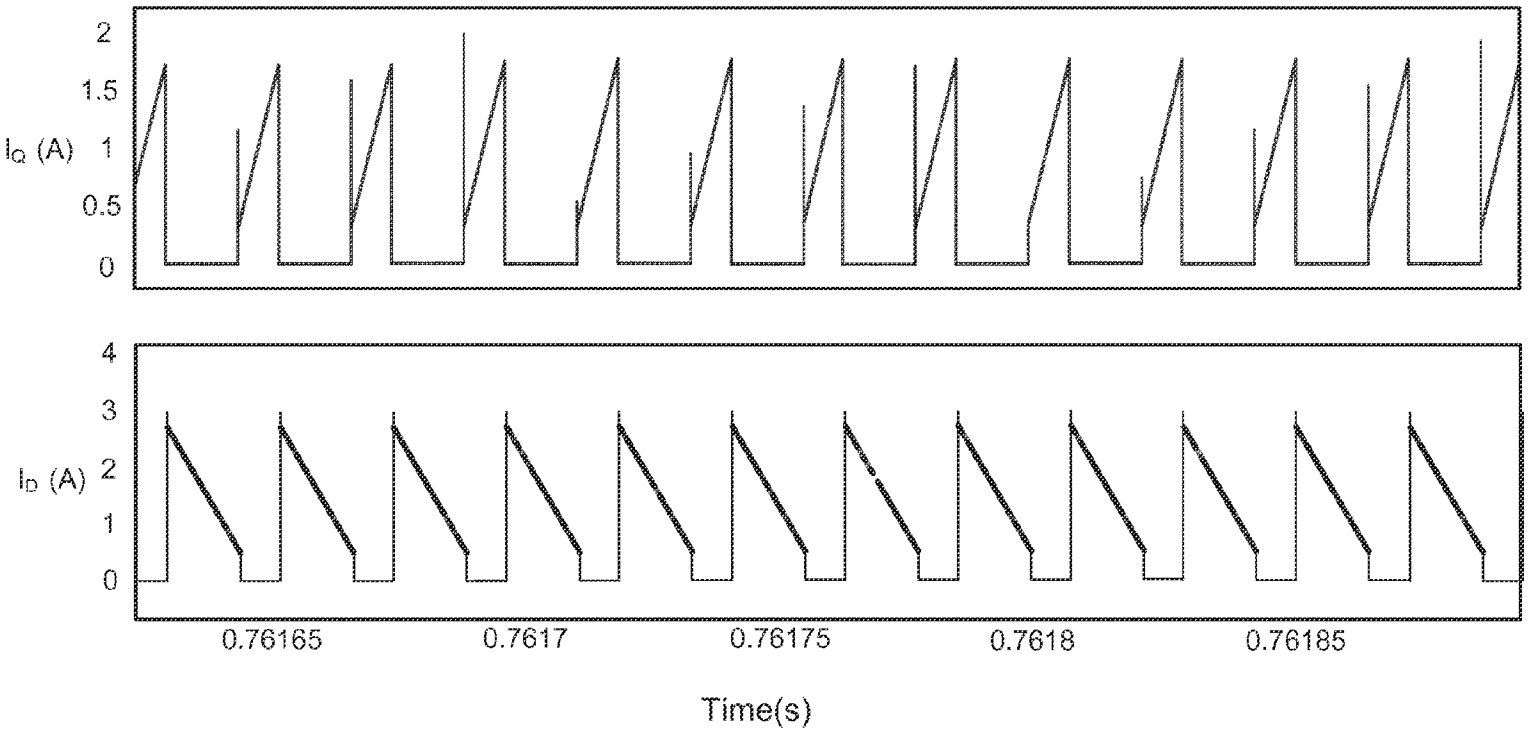

Please refer to FIG. 13A and FIG. 13B, there are shown simulated signal waveforms of the LED luminaire driving circuit working under CCM operation. The simulated signal waveforms shown by FIG. 13A and FIG. 13B have been proved that the LED luminaire driving circuit 1 proposed by the present invention can provide stable output voltage signal $V_O$ and output current signal $I_O$, and simultaneously performs excellent stability and current modulation error rate (<±3%). In addition, from FIG. 13A, it can find that the power factor (PF) of the LED luminaire driving circuit 1 working under CCM operation (i.e., $V_S$=110$V_{rms}$) reaches to 0.991, and the working current $I_{LED}$ of the LED lighting unit 14 oppositely reaches to 519 mA.

Figure 14A:
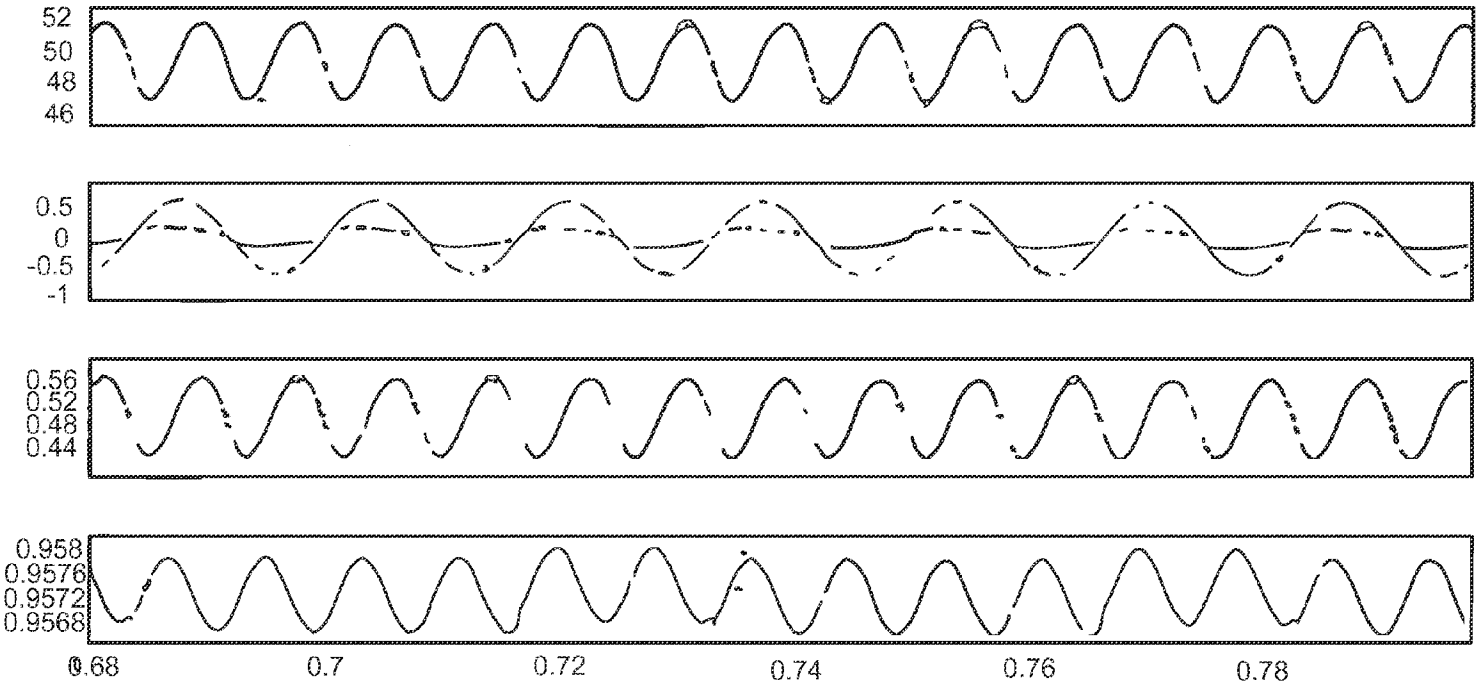
FIG. 14A and FIG. 14B show simulated signal waveforms of the LED luminaire driving circuit working under DCM operation.
Figure 14B:
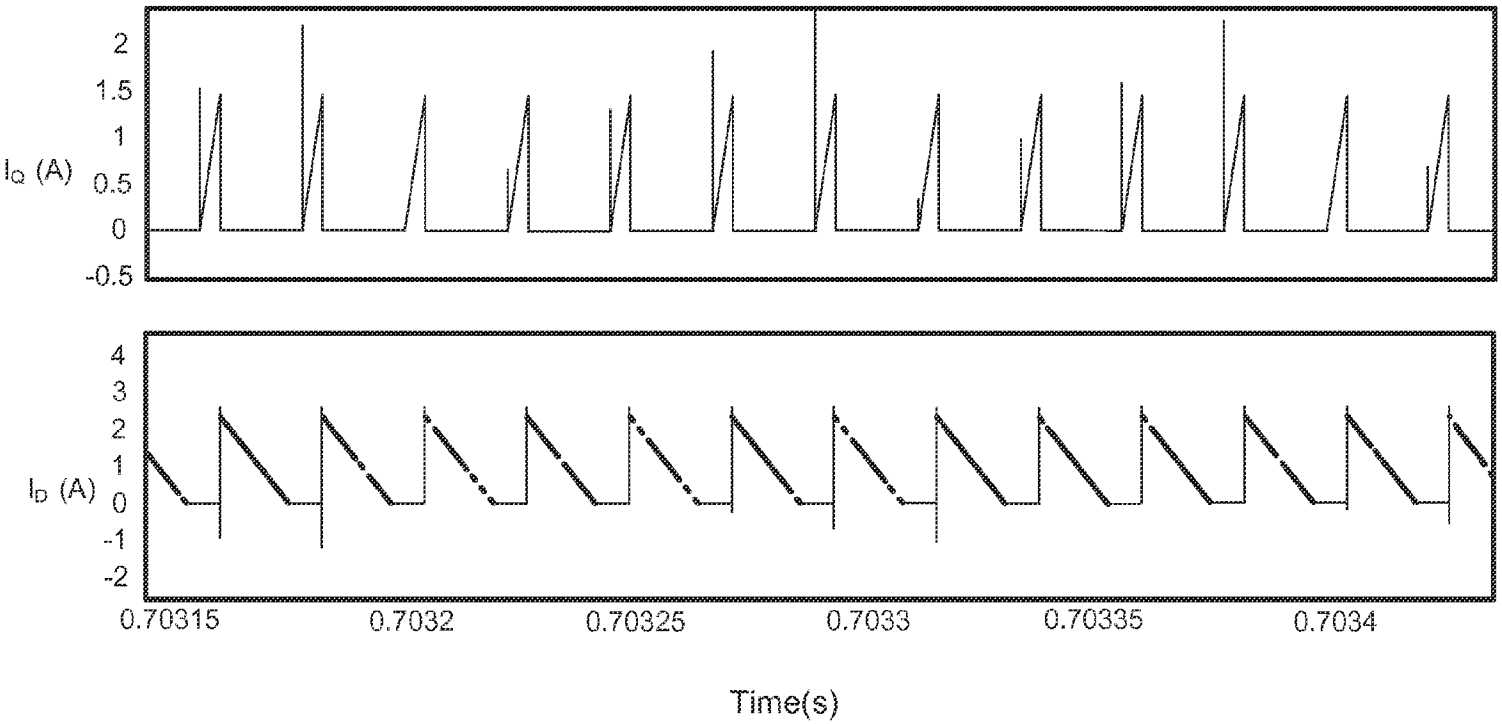

Moreover, please refer to FIG. 14A and FIG. 14B, there are shown simulated signal waveforms of the LED luminaire driving circuit working under DCM operation. The simulated signal waveforms shown by FIG. 14A and FIG. 14B have been proved that the LED luminaire driving circuit 1 proposed by the present invention can provide stable output voltage signal $V_O$ and output current signal $I_O$, and simultaneously performs excellent stability and current modulation error rate (<±3%). In addition, from FIG. 14A, it can find that the power factor (PF) of the LED luminaire driving circuit 1 working under DCM operation (i.e., $V_S$=220$V_{rms}$) reaches to 0.953, and the working current $I_{LED}$ of the LED lighting unit 14 oppositely reaches to 501 mA. Therefore, the simulated signal waveforms of FIG. 13A, FIG. 13B, FIG. 14A, and FIG. 14B proves that the LED luminaire driving circuit 1 proposed by the present invention can indeed works under different mode (CDM or DCM) operation with high power factor.

The above description is made on embodiments of the present invention. However, the embodiments are not intended to limit scope of the present invention, and all equivalent implementations or alterations within the spirit of the present invention still fall within the scope of the present invention.

What is claimed is:

1. An LED luminaire driving circuit with high power factor, comprising:

a filter unit, being coupled to an input source for receiving an AC signal;

a rectifier unit, being coupled to the filter unit for receiving the AC signal via the filter unit, and then treats the AC signal with a rectifying process so as to output an input signal;

a transformer unit, being coupled to the rectifier unit for receiving the input signal, and transforming the input signal having a peak input voltage to an output signal having a peak output voltage, so as to output the output signal to an LED lighting unit for making the LED lighting unit emit light;

a power switch unit, being coupled between the rectifier unit and the transformer unit and used for treating the input signal with switching control;

a zero current detecting unit, being coupled to the transformer unit and used for treating the output signal with a zero current detection, so as to output a zero current detection signal;

a feedback unit, being coupled to the zero current detecting unit and the power switch unit, wherein the feedback unit receives a power switch current of the power switch unit and the zero current detection signal, and outputting a feedback signal according to the power switch current and the zero current detection signal; wherein the feedback unit comprises:

a low pass filter, being coupled to power switch unit for receiving the power switch current, so as to treat the power switch current with a low pass filtering process; and a multiplexer, being coupled to the low pass filter and the zero current detecting unit for receiving the zero current detection signal and the low-pass-filtered power switch current, so as to output the feedback signal;

an error amplifier unit, being coupled to the zero current detecting unit and the feedback unit for receiving the feedback signal, and then outputs an error amplification signal according to the feedback signal; and a power switch driving unit, being coupled to the power switch unit and the error amplifier unit for receiving the error amplification signal, and then outputs a driving signal to the power switch unit according to the error amplification signal, so as to drive the power switch unit to treat the input signal with switching control.

2. The LED luminaire driving circuit with high power factor of claim 1, wherein the power switch unit comprises a Power Metal-Oxide-Semiconductor Field-Effect Transistor (power MOSFET), and the source terminal of the power MOSFET being coupled with a source resistor.

3. The LED luminaire driving circuit with high power factor of claim 1, wherein filter unit comprises a first capacitor, a common mode chock winding and a second capacitor, in which the first capacitor is connected across the two input terminals of the common mode chock winding, and the second capacitor being connected across the two output terminals of the common mode chock winding.

4. The LED luminaire driving circuit with high power factor of claim 1, wherein the rectifier unit is a bridge rectifier.

5. The LED luminaire driving circuit with high power factor of claim 1, wherein the feedback unit further comprises a relay coupled between the multiplexer and the error amplifier unit.

6. The LED luminaire driving circuit with high power factor of claim 1, wherein the error amplifier unit comprises:

a proportional-integral (PI) compensator, being coupled to the feedback unit for receiving the feedback signal; and a multiplexer, being coupled to the power switch driving unit for receiving the driving signal, moreover the multiplexer further be coupled with a reference current signal, such that the multiplexer is able to output a reference voltage signal to the PI compensator according to the driving signal and the reference current signal, and then the PI compensator may output the error amplification signal according to the reference voltage signal and the feedback signal.

7. The LED luminaire driving circuit with high power factor of claim 1, wherein the power switch driving unit comprises:

a subtractor, being coupled to the error amplifier unit for receiving the error amplification signal, moreover the subtractor further be coupled with a ripple signal, such that the subtractor is able to output a conversion signal according to the ripple signal and the error amplification signal;

a comparator, being coupled to the subtractor and the power switch unit for receiving the conversion signal and a power switch voltage signal of the power switch unit, respectively; therefore the comparator may output a comparison signal according to the power switch voltage signal and the conversion signal; and a Set/Reset flip flop, being coupled to the output end of the comparator by one reset end thereof, moreover one set end of the Set/Reset flip flop is coupled with a clock signal, such that the Set/Reset flip flop is able to output the driving signal to the power switch unit according the clock signal and the comparison signal received from the comparator.

8. The LED luminaire driving circuit with high power factor of claim 1, further comprising: an output unit, being coupled between the transformer unit and the LED lighting unit, wherein the output unit is used for outputting the output signal to the LED lighting unit for making the LED lighting unit emit light.

9. The LED luminaire driving circuit with high power factor of claim 8, further comprising: a signal detecting unit, being coupled between the transformer unit and the zero current detecting unit, wherein the signal detecting unit is used for detecting the output signal, so as to output a detection signal to the zero current detecting unit.

10. The LED luminaire driving circuit with high power factor of claim 9, wherein the zero current detecting unit comprises:

a comparator, being coupled to the signal detecting unit for receiving the detection signal, and having a first input end, a second input end and an output end;

an adder, being coupled between the first input end and the output end of the comparator, and the adder further being coupled with a reference signal;

an inverter, being coupled to the output end of the comparator; and a Set/Reset flip flop, being respectively coupled to the invertor and the power switch unit by one reset end and one set end thereof.

11. The LED luminaire driving circuit with high power factor of claim 9, wherein the transformer unit has a primary winding coil, a secondary winding coil and an auxiliary winding coil.

12. The LED luminaire driving circuit with high power factor of claim 11, wherein the output unit comprises:

an output diode, being coupled to the one terminal of the primary winding coil by one end thereof; and an output capacitor, being coupled to the other end of the output diode by one end thereof, moreover the other end of the output capacitor is coupled to other terminal of the primary winding coil and the LED lighting unit.

13. The LED luminaire driving circuit with high power factor of claim 11, wherein the signal detecting unit has at least one resistor, in which one end of the resistor is coupled to one terminal of the auxiliary winding coil, and the other end of the resistor being coupled to the other terminal of the auxiliary winding coil and the ground of the LED luminaire driving circuit with high power factor.

* * * * *